US008595988B2

(12) United States Patent
Graf Fernandez

(10) Patent No.: US 8,595,988 B2
(45) Date of Patent: Dec. 3, 2013

(54) CONSTRUCTION METHOD AND SYSTEM WITH CONTAINERS

(76) Inventor: Rodrigo Graf Fernandez, Mexico City (MX)

( * ) Notice: Subject to any disclaimer, the term of this patent is extended or adjusted under 35 U.S.C. 154(b) by 24 days.

(21) Appl. No.: 13/051,408

(22) Filed: Mar. 18, 2011

(65) Prior Publication Data

US 2011/0232202 A1 Sep. 29, 2011

Related U.S. Application Data

(60) Provisional application No. 61/317,392, filed on Mar. 25, 2010.

(51) Int. Cl.
*E04H 6/00* (2006.01)

(52) U.S. Cl.
USPC ..... 52/79.9; 52/79.5

(58) Field of Classification Search
USPC ..... 52/79.1, 79.7, 79.9, 79.14, 741.4, 52/741.14, 438
See application file for complete search history.

(56) References Cited

U.S. PATENT DOCUMENTS

| | | | | |
|---|---|---|---|---|
| 4,854,094 | A * | 8/1989 | Clark | 52/79.1 |
| 4,882,883 | A * | 11/1989 | Horn | 52/79.1 |
| 5,706,614 | A * | 1/1998 | Wiley et al. | 52/79.1 |
| 6,508,043 | B1 * | 1/2003 | Bond et al. | 52/742.14 |
| 6,513,670 | B2 * | 2/2003 | Minkkinen | 220/1.5 |
| 6,562,474 | B1 * | 5/2003 | Yoshimi et al. | 428/472.3 |
| 6,675,540 | B1 * | 1/2004 | Rokes | 52/143 |
| 8,001,730 | B2 * | 8/2011 | Wallance | 52/79.1 |
| 2003/0009954 | A1 * | 1/2003 | Bradley | 52/79.1 |
| 2003/0188507 | A1 | 10/2003 | Cote | |
| 2008/0233295 | A1 * | 9/2008 | Ye et al. | 427/372.2 |
| 2009/0019811 | A1 | 1/2009 | Goldman | |
| 2009/0260302 | A1 | 10/2009 | Graf | |

FOREIGN PATENT DOCUMENTS

| | | |
|---|---|---|
| DE | 3531528 | 3/1986 |
| JP | 10252292 | 9/1998 |
| JP | 2009108610 | 5/2009 |
| SE | 516 867 | 3/2002 |
| WO | 96/30601 | 10/1996 |
| WO | 2005/007540 | 1/2005 |

* cited by examiner

*Primary Examiner* — William Gilbert
*Assistant Examiner* — Beth Stephan
(74) *Attorney, Agent, or Firm* — Roylance, Abrams, Berdo & Goodman, L.L.P.

(57) ABSTRACT

A habitable structure formed by a container having walls, the container walls having openings and cement or concrete surrounding the container walls, the cement or concrete is adhered, fixed or anchored to the container walls through said openings.

15 Claims, 5 Drawing Sheets

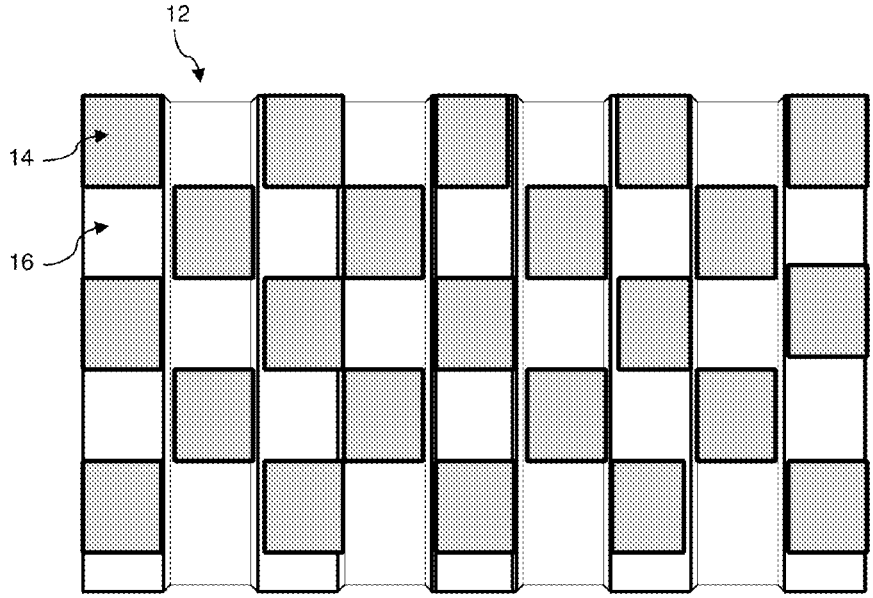
Fig. 3
Fig. 4
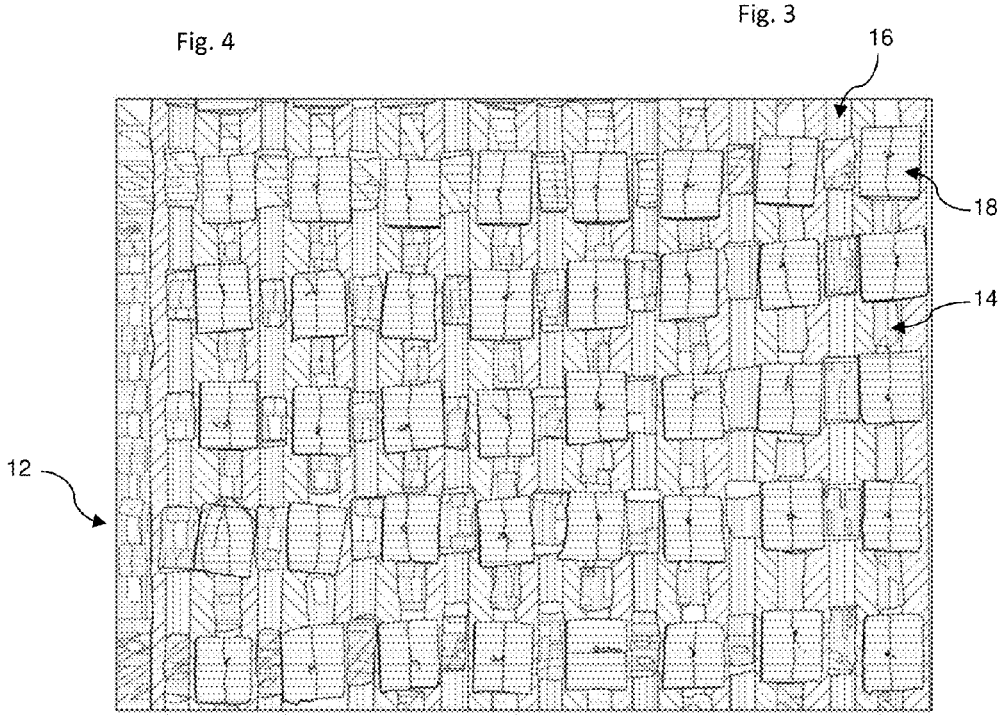

CONSTRUCTION METHOD AND SYSTEM WITH CONTAINERS

CROSS-REFERENCE TO RELATED APPLICATION

This application claims benefit of provisional application Ser. No. 61/317,392 filed on Mar. 25, 2010.

FIELD OF THE INVENTION

The present invention is related with containers whose original structure is modified to provide a traditional rebar-concrete-like livable or usable habitat or building. More specifically, the present invention is related with shipping containers whose original structure is modified by adding cement or concrete to at least part of the container and a construction method for said shipping containers.

DESCRIPTION OF RELATED ART

Constructions systems and methods using prefabricated structures, such as semi-trailer or shipping containers is known in the art.

For example, document DE 3431528 discloses a container comprising lightweight concrete with a lightweight synthetic fiber reinforcement, having straight, flat surfaces and rectangular edges. It can therefore be made from a single casting. Driving lugs, which are provided, serve to enable a plurality of container to be connected side-by-side and end-to-end to form a raft. Sealing with a water-based epoxy resin and a curing agent makes the container absolutely watertight. A tightly sealing cover is provided for the transport of problem wastes. Because of its low weight it can also be transported on wagons and in container ships.

Document WO 96/30601 discloses a transportable building system includes a cargo shipping container and a plurality of components carried in or on the container, or forming part of the container. The components may be rearranged and/or interconnected to provide a structure incorporating the container. These components include structural members adapted to be stored within the container during transport but to be fastened to the container in the erected structure so as to project from the container. The respective structural members when so fastened form load bearing frame components of the structure for supporting further components above the container.

Japanese publication No. 10252292 discloses a building consisting of one or more stories is formed in layers from plate-form frames and containers furnished with windows, doorways, etc. The containers and frames are consolidated in a single piece by coupling receptacle metal pieces fixed to the four inside corners of the containers through respective fixtures with receptacle metal pieces fixed to the frames and having substantially the same shape as the first named receptacle metal pieces for containers.

Swedish publication No. 200000830 discloses that the walls, roof and floor of the container are formed by metal stand frames made from e.g. aluminium, inside which lightweight sandwich laminated panels with a high rigidity are fitted using e.g. screws or rivets. The construction can be transported as an ISO standard container to the end location, where electronic equipment (e.g. telecommunication, signalling or electric power equipment) can be installed locally.

US publication No. 20030188507 discloses a method of constructing modular, multi-use, enclosed shelters by recycling modular shipping containers, including the steps of determining a desired type of enclosed shelter module compatible with the dimensions of a modular shipping container, determining structural and functional components necessary for the selected type of enclosed shelter module, packing the structural and functional components into the modular shipping container, transporting the packed shipping container to a site selected for the enclosed shelter module, unpacking the structural and functional components from the shipping container, and assembling the structural and functional components into and onto the shipping container to convert the shipping container into the desired type of enclosed shelter module. Modular, multi-use enclosed shelters may be constructed by assembling a plurality of shipping containers converted into one or more types of enclosed shelter modules into a multi-element structure, wherein each element of the structure is comprised of a converted shipping container and the shipping containers are joined by means of the mechanisms normally provided to interlock multiple modular shipping containers during shipping.

WO publication No. 2005/07540 discloses a method and apparatus for transforming a plurality of standard-size shipping containers into a finished multi-level building structure of a scale to accommodate humans. Each of the illustrated shipping containers has an open generally rectangular center structural frame which supports panels to provide exterior base, end and top walls. A pair of movable side walls, each having a structural frame and wall panel, are connected to the center frame to complete the enclosure. The containers hold wall and roof sections. Initially the containers are stacked atop one another with their base walls at the bottom. Then, starting at the lowermost container, the side walls, which are hingedly connected along their bottom edges to the center frame, are opened by being pivoted outwardly, downwardly to provide extended floor portions that are in general horizontal alignment with the associated base wall. Then support structures or members are secured to that extended floor portions to provide support for the extended floor portions of the next higher level. Next, the moveable side walls of the next higher container are similarly opened and secured to the support members so as to generally vertically align with the extended floor portions below them. This continues until all the stacked containers have been opened. Finally, wall and roof panels stored in the containers are removed and installed.

US publication No. 20090019811 discloses a tubular steel frame housing module built in a factory and then transferred within a standard intermodal shipping container for installation within a structural framework at a remote building site.

Japanese publication No. 2009108610 discloses temporary building comprises a first container member having no both side surfaces in the depth direction of the container, a second container member disposed away from the first container member and having no one side surface in the depth direction of the container, and a third container member arranged so as to be overlapped with both the first and second container members and having a wider width and higher height than those of the first and second container members and removing both sides surfaces in the depth direction of the container and a lower surface.

Japanese publications Nos. 2009127339 and 2009150110 disclose a container house is unitized by internal division of labor, and foreign-made interior decorative glass, special furniture, or the like is used to produce a sense of high quality while reducing cost.

Finally, U.S. patent application Ser. No. 12/427,887 with publication No. 2009/0260302 corresponding to the same inventor than the present application, discloses building system and method by means of at least two prefabricated structures comprising a first prefabricated structure containing at least two lateral walls, a front wall and a back wall; a second prefabricated structure containing at least two lateral walls, a front wall and a back wall; a first transportation axis in which said first prefabricated structure is mounted, capable of towing said first prefabricated structure to a building site and said first transportation axis is parked in the construction site; a second transportation axis in which said second prefabricated structure is mounted, capable of towing said second prefabricated structure to said building site and said second transportation axis is parked in the construction site; at least one of said lateral, back or from wall of each one of said first and second prefabricated structure is dismounted, dismantled or rolled up; wherein said first and second prefabricated structures are joined in such a manner that said prefabricated structures are in communication by said dismounted, dismantled or rolled up side.

All of the above prior art documents use modified containers, preferably shipping containers. However, none of the prior art documents disclose or suggest modifying containers so that concrete or cement is fastened, adhered or anchored to the wall of the container or a part of the container to create a traditional-like rebar/concrete construction. Also, the above prior art documents do not disclose or suggest modifying a container so that above the concrete or cement, the walls, floors or ceilings may be coated with further material, such as wood, carpet or wood laminates, wherein said further material may be fastened on top of the cement or concrete. Furthermore, all of the above prior art documents do not disclose or suggest a method of preparing the containers for their modifications, specifically a method of repairing and modifying containers so that they meet construction standards.

BRIEF SUMMARY OF THE INVENTION

The invention refers to a container construction system and method with new or used containers, comprising adhering, fixing or anchoring cement or concrete to the steel walls, floors and ceilings of the container (as rebar's) or at least part of the container, providing a traditional-like cement or concrete construction.

A container is selected, and according to the different needs for the construction of the habitable structure, a container length is selected.

The selected container may then be re-forced according to the architectonical model to use in the design, such as dry or high in accordance with the selected container.

Re-enforcing elements can be applied throughout the wall structure of the selected container, as well as throughout the floor and ceiling structures; optionally re-enforcing elements are applied in selected areas of the wall structure, floor and ceiling structures. Optionally, the selected container is then cleaned by any existing method like sandblasting, ice blasting or by hand. A primer or pore sealer may then applied, preferably throughout the walls, ceiling and floor structure of the container. If desired, a water resistant coating may then applied to the columns and structural elements that will be in contact with the floor on which the container will be seated. If the container will be fastened with other containers, fastening bolts are placed in the ribs in the ends of the container, so as to fasten a first container with a further container. If necessary, windows, doors and wall, floor or ceiling elimination are traced and cut. The container may then be disinfected with a bactericide or other existing methods. The container may then be degreased and cleaned with a de-fixing chemical, applied with a hydro-washing machine. A primer removing chemical may then be applied in the wall crests of the container in both the inner and outer face of the container. The walls of the container are then drilled, bored or pierced so as to obtain openings in the steel walls (so the existing steel can act or perform as a traditional reinforcement bar known as "rebar"); the openings may be shaped substantially in any forms such as geometrical shapes (quadrangular, triangular, etc) or such as "X", "O", "A", "L", "C", "U", shapes with different measurements. Preferably at least two openings are placed throughout the container, preferably at least two openings per each 60 longitudinal centimeters. Data, voice, electric, sanitary, hydraulic and other installations are then placed in the container if necessary. Adhesive may then be applied to the walls, both in the inner and outer parts of the container. A thermal and/or sound insulator may then be placed over the walls, over said adhesive, the insulator being selected from thermal insulator, extruded polystyrene, insufom, Styrofoam, polyurethane or similar materials. The container wall, floor and ceiling surface may then be enabled and fastened for mechanical traction or other traction methods, carried out with preferably with a mesh 31, preferably an hexagonal mesh, fastened over the laminate surface of the container, both in the inner and outer parts of the container. Metallic slave guides may then be placed, so as to later place master guides. Cement or concrete is then poured over the walls with the guides creating a similar effect to formwork. The mortar, cement or concrete may be placed by means of a gun mechanism or any other existing method. The mortar is then measured so as to comply with measuring requirements for placement in the inner and outer walls of the container. The surface is then floated to tune the base of the floating foam. Concrete curing is carried out by normal methods and preferably with an atomized water or vapor barrier for a time period of between 1 to 15 hours or according to the cement composites. Curing for approximately between 1 and 15 hours is carried out, depending on the cement type, ensuring resistance of the cement or concrete as shown in FIG. 6.

Finally, a system similar to that described by Graf in publication US 2009/0260302 may be carried out. Therefore, the Graf reference is incorporated by reference, however, the extent of some statements might be considered inconsistent with the patenting of this invention, such statements are expressly not considered as made by the applicant of the present invention.

Even though any type of cement or concrete is feasible for the present invention, the preferred cement or concrete used by the present invention is a cement blend with quick hydraulic setting and fine sand, giving it the appearance of elaborate mortar.

BRIEF DESCRIPTION OF THE DRAWINGS

FIG. 3 is a front detailed view of a container wall, showing the openings and unpierced sections.

FIG. 4 is a front detailed view of a container wall with insulators and fixing means.

DETAILED DESCRIPTION OF THE INVENTION

The invention refers to a construction system and method with new or used containers, such as trailer or shipping containers, and preferably shipping containers in view of their structural rigidity, containers in which cement or concrete 30 is firmly adhered or incorporated to the walls, floor and/or ceiling. The container construction system is destined for a habitable structure. Therefore, a traditional concrete or cement construction is achieved, construction which can be built in a speedy manner, with low cost and high structural capabilities. The construction can be easily re-located and can be recovered up to 100%, hence reducing the risk of losing a construction investment given that it may be re-located to a different location. Furthermore, this type of construction allows the growth and expansion according to a given demand and may be installed in remote locations which would increase the investment needed to build in a common construction. Furthermore, this type of construction may be stored, hence, and given that the building time for these types of construction is lower than that of a usual construction, the built containers may be stored in the place of production, for its expedited shipment and installment. Furthermore, advantages of this type of construction include greater safety in fires, floods, quakes, hurricanes and vandalism acts, that is, the construction naturally provides an armor capability that can be increased to most types of armor levels, that is, the construction is weapon resistant. The load provided by this type of construction is greater than a traditional construction at the same cost. Specifically, without further modification, at least five (5) levels may be attained by being stacked one on top of the other. The construction of the proposed system is at least 15% more durable than a traditional construction if the above mentioned concrete is incorporated into the container structure, since among other features, they are resistant to sub-ground collapses and withhold high seismic activities. Therefore, in view of the above advantages, the shelter provided by the present invention has greater advantages than a traditional re-bar and concrete construction.

For the present invention, the term "wall" may refer to any of the lateral walls of a container, or may also refer to the floor or ceiling of the container.

Figure 1:
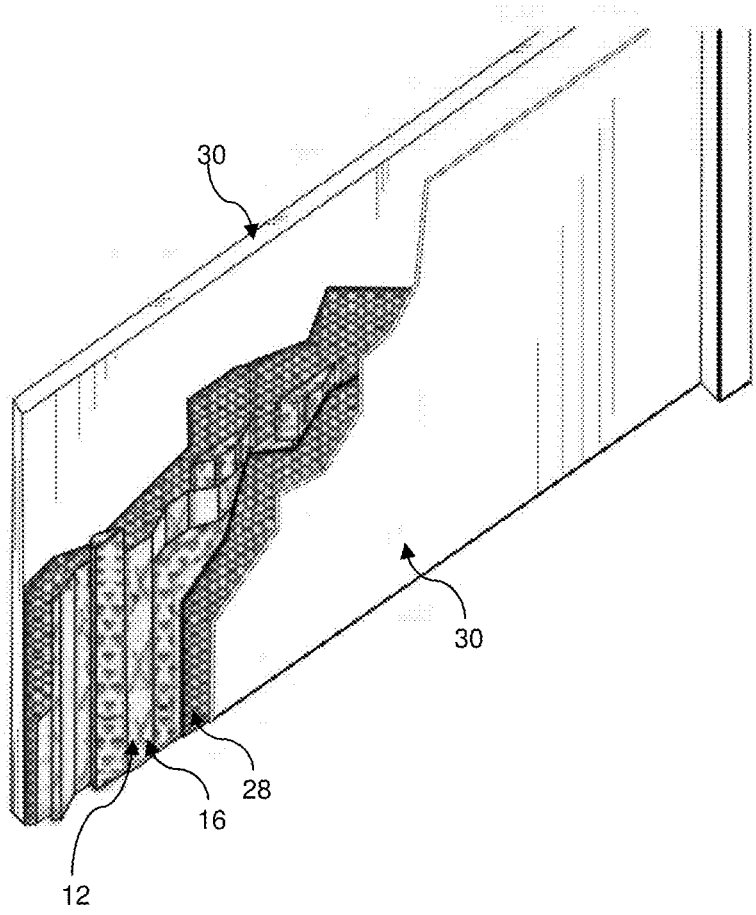
FIG. 1 is a cross-section view of a container wall showing the preparation of the container wall, specifically the grooves in the walls, as well as each layer added to the container wall.
Figure 2:
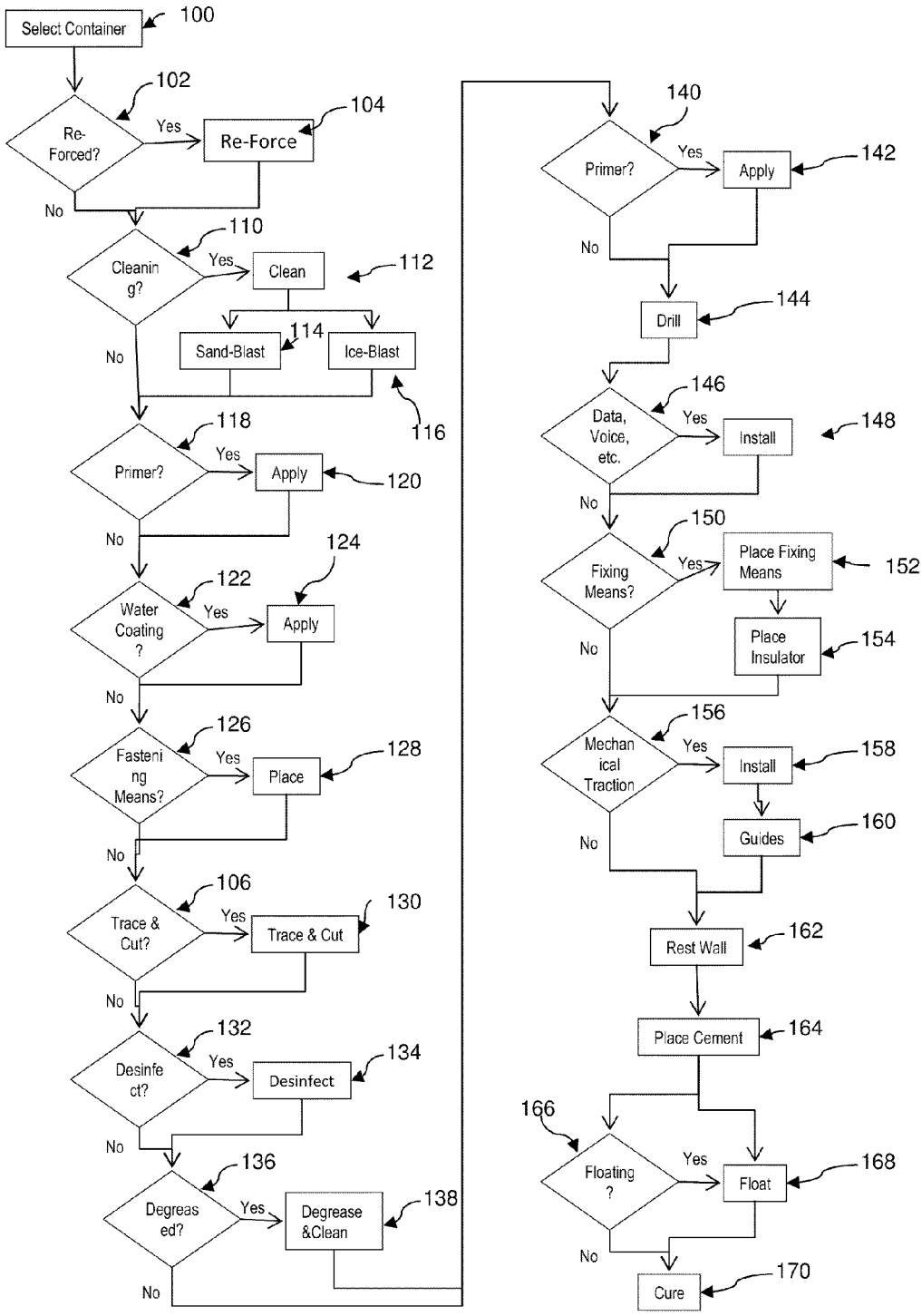
FIG. 2 is a flow diagram of the method for the construction of habitable structures with containers.
Figure 5:
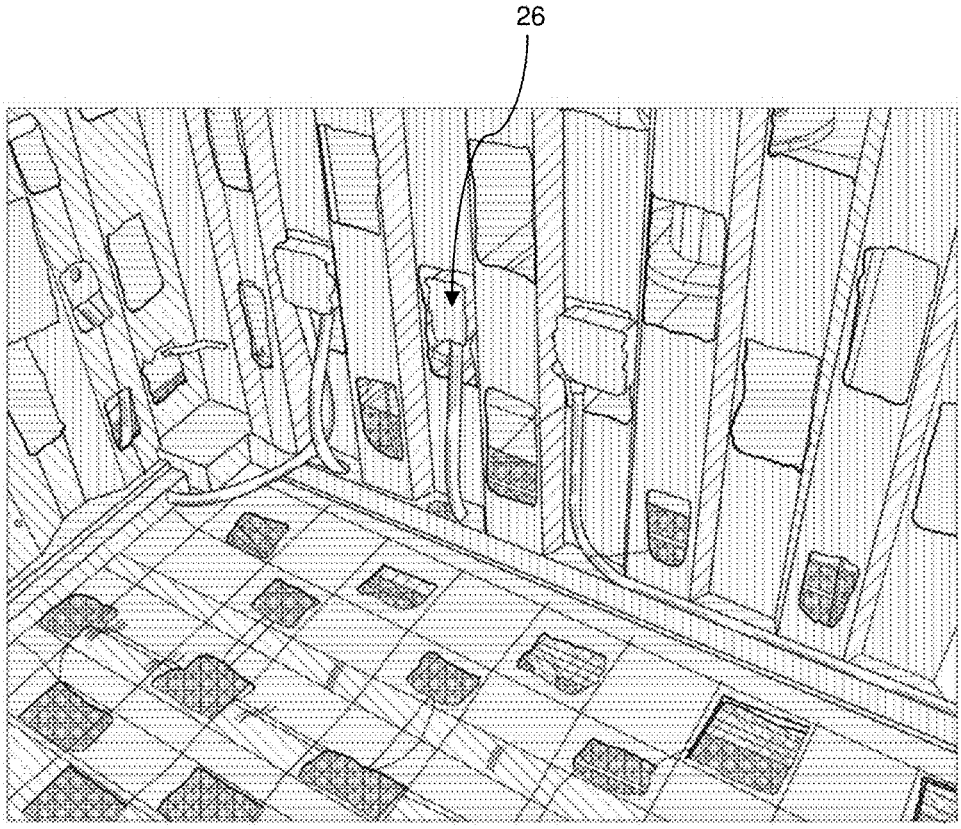
FIG. 5 is a conventional perspective view of an inner corner of the container, in which installations and services have been placed.

In reference to FIG. 2, the following steps are carried out to complete the construction system.

A container is selected 100, and according to the different needs for the construction, a container length is selected or modified according to the desire length.

If needed, the selected container 100 is then re-enforced 102, 104 according to the architectonical model to use in the design, such as dry or high in accordance with the selected container. Re-enforcing elements can be applied throughout the wall structure of the selected container; optionally re-enforcing elements are applied in selected areas of the wall structure. The re-enforcing elements may be such as beams or cantilevers. Structural re-enforcements coming from other containers can be used as structural material, due to the fact that the floors of the containers are conformed by an "I" or "C" profile, and have structural frames which form the front and end of the containers. Optionally, the re-enforcement elements may be the longitudinal elements in the containers which receive the walls of the grooved sheet, which are also structural elements of the container. Therefore, according to the architectonic model and its structural analysis, floors, structural frames and/or longitudinal elements may be selected. It is preferred that the container should be re-enforced if the load the container will receive is high. Containers are known to be stacked one above another. However, given the weight provided by the concrete or cement 30 that each of the walls of the container will have at the end of the process, the weight of the container is increased. The container parts may be its natural supporting elements, such as its beams, floors, frames and longitudinal elements in the walls support a heavy weight above such container. Multiple containers can been stacked without bending the lower container or collapsing the lower container. However, if the height of the stack is increased and more containers are stacked, the frame of the lower container could be bent or the lower container(s) could collapse. Therefore, it is preferred that if four or more containers will be stacked, re-enforcing elements, such as the ones described above are placed in the lowest container.

If necessary, the selected container may then be cleaned 110, 112 by sandblasting 114, ice blasting 116 or any other existing method. Sandblasting or vacuum blasting 114 is a process for cleaning metallic surfaces, in which metallic powders, mixed with impact shot (balls) are blasted onto the walls of the container. By means of sand blasting, the coating of the container wall has no emissions of zinc, tin, copper, aluminum or other metals. When sand blasting, a coating with the particles is formed in the container wall by means of mechanical embedding, adhesion force and micro-welding. The unconsumed mixture of powder if vacuumed off, separated from the air flow by means of a separator and returned to the process for further sand-basting to the next wall. Through means of ice-blasting 116, the walls are cleaned without chemicals or solvents, and is a non-abrasive method of cleaning, hence eliminating the wear and tear of the walls resulting from other processes. Dry ice is created by liquefying carbon dioxide under pressure and then allowing it to expand rapidly. In the process part of the carbon dioxide evaporates and cools the remainder to such extent that it freezes creating carbon dioxide snow. Pellets are formed by means of an extruder. The pellets are then injected to a jet of compressed air, accelerated to speed in excess of 150 m/s and fired at the container walls. Optionally, both or more cleaning methods may be carried out. If the source and load history of the container is known, other cleaning methods may be sought as long as the integrity of the container is not compromised. For example, other cleaning methods included could such as water and soap, de-greasers, metallic barbs, which help removing semi-solid elements, among others. If the container is not cleaned, the cement or concrete could eventually be stained by the container, as well as the paint or sealant above the cement or concrete.

If necessary, a primer or pore sealer is then applied 118, 120, preferably throughout the wall structure of the container. The primer or pore sealer may be selected among any steel primer or steel pore sealer. Preferably, the primer or pore sealer is an oxide inhibitor that generates magnetite, thus stopping rust in the container and increasing the durability of the container in regards to the health of its steel. Given that magnetite may be increased, and that steel pores are sealed, the formation of a coating is carried out which does not allow penetration of oxygen, hence oxide is repelled from the container walls. In a long term, if the primer or pore sealer is not applied, the structure of the container could be weakened, hence shortening the life time of the habitable structure. The primer or pore sealer may be applied to the walls by means of known methods, such as by means of a pneumatic gun, spray or paintbrush. Given that oxidation is not present in new containers, new containers do not need to carry out the application of a primer or pore sealer 118, 120.

If necessary, a water resistant coating is then applied 122, 124 to the columns and structural elements. Preferably the water resistant coating is applied to the parts of the container that will be proximate to or in contact with the floor on which the habitable structure will be seated. The water resistant coating is preferably an oxide corrector, which will provide a second magnetite coating, hence avoiding generation of oxide. This second coating is preferably applied to the columns and structural elements, however, may be applied to the whole container. The application of a water resistant coating will lengthen the life span of the container. This second coating may be applied in a similar manner to that of the first coating.

If the architectural design is composed of two or more modules, units or containers, fastening bolts or other fastening means can be placed 126, 128 in the ribs in the ends of the container, so as to fasten a first container with a further container. If there will only be a single container, fastening means are not placed in the ribs of the ends of the container. However, if more than one container will be joined, then the fastening means have to be placed in the ribs of the ends of the container. Other fastening means may include welding. If the fastening means are bolts, it is preferred that the bolds are double threaded face bolts. If moved, the containers tend to separate; the fastening means prevent separation of the different containers.

Windows, doors and wall, floor or ceiling elimination is traced and cut 106, 130. Depending on the architectural design of the habitable structure, doors and windows are traced in the container. Cutting methods are those commonly known in the art, such as gas, laser or plasma cutting. There may be no need of such tracing and cutting, since the container has doors, therefore, this step of tracing and cutting is an optional step.

The container may then disinfected 132, 134 with a bactericide or other existing methods. This step is a preventive measure, for hygiene and hence the habitability of the habitable structure, however not a necessary measure. The bactericide which is used is a wide spectrum bactericide. Alternative methods used are sandblasting, ice-blasting or sanded with an abrasive, such as sandpaper.

The container is preferably then degreased and cleaned 136, 138 with a de-fixing chemical, applied with a hydro-washing machine or by hand. The de-fixing chemical, which may be a commercial degreaser or common soap and water, detaches any grease the container walls may have, generates an optimal surface for the adherence of the cement or concrete to the container wall. Grease is an element that may be detrimental to the performance and adherence of the cement or concrete to the container, interfering in the adhesiveness between the steel and the cement or concrete. A hydro-washer is used to apply the degreaser due to the speed of application, however, the degreaser may be applied by a common paintbrush or roller or a humid and dry rag. The above will not only improve the adherence between the steel of the container wall and the cement or concrete, but will also avoid stains in the cement or concrete.

A primer removing chemical is then optionally applied 140, 142 in the wall crests of the container in both the inner and outer face of the container. The primer removing chemical is applied to remove any degreaser left in the walls, so as to ensure the cement or concrete to the steel walls of the container and avoid any looseness of the cement or concrete to said walls. Otherwise, when the container is transported, and due to vibration of the transportation, the cement or concrete could detach from the walls of the container.

The walls of the container are then drilled 144, bored or pierced so as to obtain at least one opening 16 in each of the walls 12 or parts of the container; the openings 16 may be shaped substantially in the form of "X", "O", "A", "L", "C", "U", "I" or any other shape. Optionally, the opening 16 may be in the shape of a quadrilateral or any other type of polygon shape. The openings 16 are created so as to allow the poured cement or concrete on a determined wall 12 or part to go through or sift from one face of a wall to the opposite face of the same wall 12. Therefore, when the cement or concrete sets, the cement or concrete on one face of the wall will adhere, fix or anchor the cement or concrete of the opposite side of the wall 12, hence both sides of cement or concrete and the steel container wall becomes monolithic. The preferable size of the opening 16 is 4 inches or less (10.2 centimeters or less) in a transverse direction and 8 inches or less (20.4 centimeters or less) in a longitudinal direction but any size can be used. Preferably at least two openings 16 are placed throughout the container wall 12, more preferably at least two openings 16 per each 23.6 longitudinal inches (60 longitudinal centimeters). More preferably, for each three un-pierced sections 14, an opening 16 may be found; yet more preferably for each un-pierced section 14 an opening may be found 16 as seen in FIG. 3. In any case, it is preferable that a vertical space no greater than 12 inches (30.5 centimeters) and a longitudinal space no greater than 36 inches (91.4 centimeters) is left un-pierced 14 and more preferable a vertical space no greater than 6 inches (15.2 centimeters) and a longitudinal space no greater than 18 inches (45.7 centimeters) is left un-pierced 14. The importance of the distance between the openings 16 is that the cement or concrete adheres correctly to the wall of the container, that is, the number of perforations, size and shape is not relevant, whereas the distance and location of the openings may be relevant. Furthermore, if the openings 16 are larger than those preferable, this does not mean that the structure of the container will weaken, rather the above size of the openings 16 relates to the efficiency of the cement or concrete to be poured in one side and pass through or sift to the other side. If the openings 16 are larger, it is possible that the inner structure of the wall will tend to vibrate, the vibration at its time may tend to cause crevasses or fissures in the concrete or cement surrounding such wall. If the openings are smaller than those preferred, it is possible that the cement or concrete that is now part of the wall will be breakable, since it will be too rigid. The wall of the containers are laminate with grooves, similar to crests and valleys, which would seem as vertical strips, wherein a single vertical strip forms a crest and wherein a single vertical strip forms a valley. Vertical strips joining the crest and valleys are also included in the laminate. All the strips are not separate rather form part of the same laminate. Preferably the location of the openings 16 and un-pierced sections 14 in the container wall 12 are not all in the same strip; that is, it is preferable that a strip is not formed by openings 16 only, since this could increase vibration of the inner structure of the container wall, nor would it be preferable to have a strip formed by un-pierced sections 14 only, since this would not allow a correct sifting of the cement or concrete. Furthermore, it is not preferred that the vertical strips joining the crest and valley sections contain openings 16.

Data, voice, electric, sanitary, hydraulic and/or other type of installations or services 26 may then be placed and fastened 146, 148 to the container. The installations are placed within a tube to make the installations in regards to the container easier, that is rather than place individual and multiple cables or tubes, a single tube contains all the cables.

If a thermal and/or sound insulator is to be placed, a fixing means, such as an adhesive is then applied 150, 152 to the walls, both in the inner and outer parts of the container. The preferred adhesive is a contact adhesive, free of solvents and water resistant, that guarantees the adherence of insulators to metal. The adhesive may be applied by means of a brush or spray to the metal container. Further fixing means may include a wire, which is used instead of the adhesive. The container may be wired throughout the openings 16 to provide a support for the insulators 18 to the metal wall of the container. Plastic may also be used instead of adhesive or wire, wherein the plastic provides stability of the position of the insulator. The adhesive, wire or plastic is meant only to temporarily guarantee the stability of the insulator with regards to the metal wall of the container, rather than to fix permanently the insulator with the metal wall of the container, that is, this function will be carried out by the set cement or concrete.

Optionally a thermal and/or sound insulator 18 is then placed 154 over the walls, over said adhesive, wire or plastic. The insulator 18 may be selected from a group consisting of thermal insulator, extruded polystyrene, Styrofoam, polyurethane or similar materials, such as polystyrene, expanded polystyrene, dry ice or fiber. The preferred insulator 18 is extruded polystyrene, since it has a good resistance, duress and inflammability, and is further an acoustic insulator.

Figure 6:
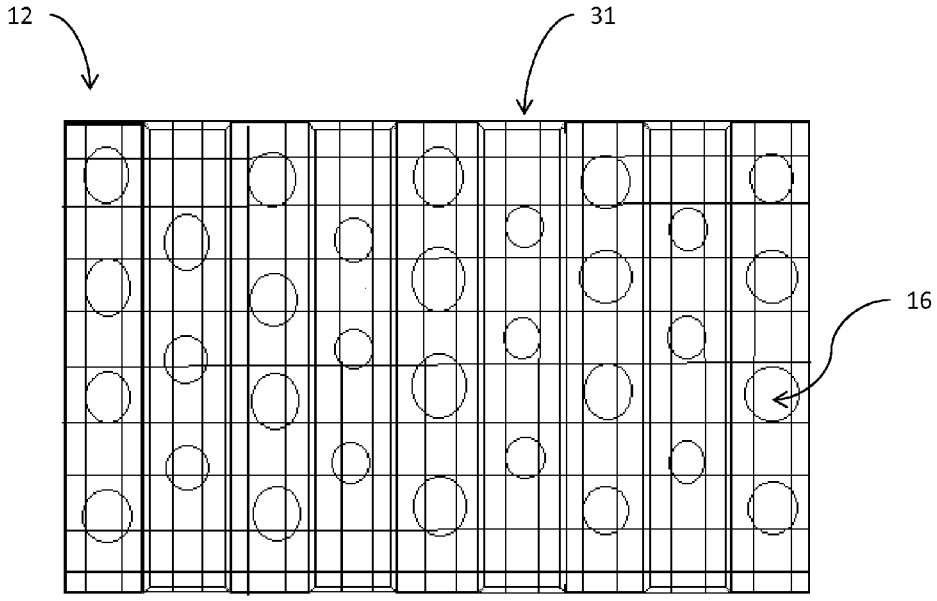
FIG. 6 illustrates a mesh fastened to a wall of the container.

The container wall surface may then be enabled and fastened for mechanical traction 156, 158 or other types of traction 28, carried out preferably with a mesh 31, more preferably an hexagonal mesh, fastened over the laminate surface of the container through the openings as illustrated in FIG. 6, wherein the mechanical traction is both in the inner and outer parts of the container. Mechanical traction may become necessary since it may be translated into the grip that the concrete or cement has to the metallic wall 12 of the container. If there were no mechanical traction, there would be no or little grip, and if there is no grip between the cement or concrete and the metallic wall of the container, the materials would not work together, hence when providing a mechanical grip, both the concrete or cement and the metallic wall of the container, are working together. The mesh 31 may be placed with the container wall by means of known fasteners, by means of wires or by means of welding the mesh with the container wall.

Metallic slave guides are then placed 160, so as to later place master guides. The guides are used to keep a boundary for the concrete or cement and for keeping a minimum and maximum thickness in each face of the container. The guides are fixed to the container wall by means of known fastening means, wire, adhesive or weld. The guides are generally placed within a determined distance between themselves so as to avoid crevasses in the concrete, and the distance between each guide will depend upon the thickness of the container wall. A preferred distance is about 60 inches (1.52 meters) between each of the guides. Master guides allow structurally controlling crevasses that may appear, whereas slave guides are divided into control gaskets and flexible gaskets. Slave guides are for the esthetical control of the crevasses.

The wall is then placed over 162 over a bed. The bed is preferably a metallic bed, such as a steel bed. The bed comprises a supporting surface similar to a metallic plate, whose surface is generally smooth; given that the supporting surface is generally smooth, this will not provide mechanical traction with the concrete or cement, hence when the concrete or cement sets, the container will be separable from the supporting surface. The bed creates a similar effect to formwork in traditional construction.

Mortar, cement or concrete is then poured over the walls 164. As stated above the guides will define the amount of concrete or cement to be poured. Furthermore, the openings 16 will allow the poured cement to go through or sift through one side of the wall to the opposite side of the container wall. Cement or concrete is poured until the guides are coated, at least partially with cement or concrete, and more preferably, until both sides have a predetermined amount of cement or concrete. The cement may also be placed, rather than by pouring, by means of a shotcrete or gunite, wherein the concrete or cement is conveyed through a hose and pneumatically projected onto the container wall at high velocity.

The concrete is then measured so as to comply with measuring requirements for placement in the inner and outer walls of the container.

The surface of the concrete or cement may then be floated 166, 168 to tune the base of the floating foam. Floating the concrete is making circles over the surface of the concrete or cement with a hard sponge or a more specific apparatus for the same purpose, allowing thick stones to go to the bottom end of the concrete or cement and the smaller sands to stay on top of the surface, hence obtaining a smoother surface. The more time the surface of the concrete is floated, the smoother the final surface will appear.

Concrete curing 170 is carried out with an atomized water or vapor barrier for a time period of between 1 to 15 hours, preferably between 1 to 7 hours and more preferably between 2 to 4 hours, or according to the cement composites. The preferred humidity should be free of saline and contaminants allowing for common hydration. The temperature should be between 18° C. and 45° C., and more preferably room temperature between 20° C. and 25° C. Such atomized water or vapor barrier is carried out within a plastic chamber. Afterwards, setting is carried out for approximately between 1 and 5 hours, depending on the cement type, ensuring resistance of the cement or concrete. The setting conditions should be a relative humidity of between 90 and 100%, a wind below 4 km/hr, more preferably below 2 km/h, and a temperature above 18° C. and below 45° C. Severe temperature changes may affect the setting hence the setting of the cement or concrete is carried out preferably indoors.

Once the cement or concrete of a determined wall is cured, the container is separated from the bed and the same process is carried out until all the walls, or at least the necessary walls or parts of the container are coated with concrete or cement.

It is preferable that the container be inverted. That is, prior to pre-forcing 102, 104 the container, the ceiling of the container should be the new floor, whilst the floor of the container should be the new ceiling. Furthermore, after or before tracing and cutting the doors and windows 130, intermediate columns or inner wall installations may be placed within the container.

A crown assembly may be placed to guide the placing of a further container if there are two or more containers conforming the habitable structure. The crown assembly allows that the deviation between containers is less than 0.0394 inches (1 mm) and more preferably less than 0.0197 inches (0.5 mm).

Alterations to the structure described through this description, can be foreseen by those experts in the field. However, it should be understood that the present description is related with the preferred embodiments of the invention, which is merely for illustrative purposes only and should not be construed as a limitation of the invention. All modification which do not depart from the spirit of the invention are included within the body of the attached claims.

The invention claimed is:

1. A habitable structure comprising:

at least one shipping container having a first, rigid, metallic side wall, and at least a rigid, metallic floor, a front, rigid, metallic wall, a back, rigid, metallic wall or a second, rigid, metallic side wall, a rigid, metallic ceiling, and a container column fixed to the first, rigid, metallic side wall and fixed to the rigid, metallic floor, at least one of the front, rigid, metallic wall, the back, rigid, metallic wall or the second side, rigid, metallic wall, comprising at least one opening and at least one un-pierced section to form a perforated metallic wall;

a first mesh fastened to a first side of at least one of the perforated metallic walls of the container and a second mesh fastened to an opposite side of said at least one metallic walls;

cement or concrete surrounding the at least one rigid, metallic wall having the mesh, metallic floor and/or ceiling, wherein the cement or concrete is adhered, fixed or anchored to the container walls, floor and ceiling through said at least one opening of the perforated metallic wall, and first and second mesh;

wherein the ceiling of the container forms the floor of the habitable structure and the floor of the container forms the ceiling of the habitable structure.

2. The habitable structure of claim 1, wherein three un-pierced sections are provided for each of said openings.

3. The habitable structure of claim 1, wherein the container comprises a re-enforcing element selected from the group consisting of a beam, a cantilever, structural material of other containers or longitudinal elements of other containers.

4. The habitable structure of claim 1, wherein the container comprises a primer or pre sealer in at least part of the container side wall, wherein the primer or pore sealer is an oxide inhibitor capable of generating magnetite.

5. The habitable structure of claim 1, wherein at least one of the container side walls comprises reinforcing elements, wherein at least part of the container column and at least part of the reinforcing elements comprise a water resistant coating, and where the part of the container column or the part of the reinforcing element which has a water resistant coating is proximate or abutting the floor on which the habitable structure will be seated.

6. The habitable structure of claim 1, wherein the container comprises at least one of the metallic side walls and the front or back metallic wall which are substantially vertical, the metallic side wall and front or back metallic walls having ends which abut and form a lower and upper vertex, wherein the at least one container is at least a first and second container, wherein fastening means are placed in the upper end of the substantially vertical metallic walls of the first container, so as to fasten the second container to the first container, wherein the fastening means are fastening bolts.

7. The habitable structure of claim 1, wherein at least one of the container metallic side walls includes at least one window or door cut from the container side wall.

8. The habitable structure of claim 1, wherein more than two openings are provided in at least one of the container rigid, metallic sidewalls wherein the ratio of openings to un-pierced sections is for each opening, three un-pierced sections are found; and as long as between each of the openings a vertical space no greater than 12 inches and a longitudinal space no greater than 36 inches is left un-pierced.

9. The habitable structure of claim 1, wherein at least one of the container rigid, metallic side walls is formed by vertical crest strips, vertical valley strips and vertical strips joining the crests and valleys, wherein the at least one opening in the container side wall is a plurality of openings wherein the strips joining the crests and valleys do not contain openings and wherein a single valley strip and wherein a single crest strip of the container side wall is not formed only of openings or un-pierced sections.

10. The habitable structure of claim 1, wherein the at least one container comprises data, voice, electric, sanitary, hydraulic or other installations or services.

11. The habitable structure of claim 1, wherein an insulator is provided between at least one of the container rigid, metallic side walls and the concrete or cement surrounding said container rigid, metallic side wall, wherein the insulator is fixed by a fixing means to the at least one container rigid, metallic wall, wherein the insulator is selected from a group consisting of thermal insulator, extruded polystyrene, Styrofoam, polyurethane, expanded polystyrene, dry ice or fiber.

12. The habitable structure of claim 1, wherein the mesh is a hexagonal mesh and is placed on the walls by means of fasteners or by welding the mesh with the container walls.

13. The habitable structure of claim 1, wherein the container is weapon resistant and resistant to collapses.

14. A concrete construction comprising:

a shipping container having a rigid, metallic side wall, rigid, metallic floor and a rigid, metallic ceiling and at least one container column abutting said rigid, metallic side wall container;

a first mesh fastened to a first side of the metallic wall of the container and a second mesh fastened to an opposite side of the metallic wall;

wherein the ceiling of the container forms the floor of the concrete construction and the floor of the container forms the ceiling of the concrete construction; and cement or concrete surrounding the side wall and the at least one container column of the shipping container, wherein the cement or concrete is adhered, fixed or anchored to the first mesh, second mesh, container rigid, metallic side wall and column.

15. The construction of claim 14, wherein the rigid, metallic side wall of the shipping container comprises at least one opening forming a perforated side wall and wherein the cement or concrete is adhered, fixed or anchored to the rigid, metallic side wall of the shipping container, at least in part by means of at least one opening formed in said side wall.

* * * * *

UNITED STATES PATENT AND TRADEMARK OFFICE

CERTIFICATE OF CORRECTION

PATENT NO. : 8,595,988 B2
APPLICATION NO. : 13/051408
DATED : December 3, 2013
INVENTOR(S) : Rodrigo Graf Fernandez It is certified that error appears in the above-identified patent and that said Letters Patent is hereby corrected as shown below:

In the Claims

Col. 11, line 23 in Claim 4, line 2, delete “pre”, and insert --pore--.

Signed and Sealed this
Twenty-second Day of April, 2014

Michelle K. Lee

Michelle K. Lee
*Deputy Director of the United States Patent and Trademark Office*